US005323756A

United States Patent [19]

Rabska

[11] Patent Number: 5,323,756

[45] Date of Patent: Jun. 28, 1994

[54] ADJUSTABLE LIMB STABILIZER AND BOWSTRING ACCELERATOR BLOCK

[75] Inventor: Don S. Rabska, Los Angeles, Calif.

[73] Assignee: Easton Aluminum, Inc., Van Nuys, Calif.

[21] Appl. No.: 13,570

[22] Filed: Feb. 4, 1993

[51] Int. Cl.[5] ..... F41B 5/14

[52] U.S. Cl. ..... 124/86; 124/88

[58] Field of Search ..... 124/23.1, 24.1, 25.6, 124/86, 88, 89; 24/514, 563

[56] References Cited

U.S. PATENT DOCUMENTS 1,960,380 5/1934 Jordan ..... 124/23.1
2,617,402 11/1952 Roemer ..... 124/23.1
3,012,552 12/1961 Allen ..... 124/23.1
3,070,083 12/1962 Gubash ..... 124/23.1
4,553,522 11/1985 Topping ..... 124/89

*Primary Examiner*—Randolph A. Reese
*Assistant Examiner*—John A. Ricci
*Attorney, Agent, or Firm*—Roth & Goldman

[57] ABSTRACT

A bow limb stabilizer and bowstring accelerator block for a recurve archery bow which is adjustably positionable on the recurve limbs of the bow on the bowstring side accelerates the bowstring to provide in an increase in arrow velocities of about 2 percent. The blocks also rapidly stabilize the bow limbs to eliminate oscillation therein after a shot. The blocks each have a centrally positioned bowstring receiving groove therein.

7 Claims, 2 Drawing Sheets

FIG. 1A
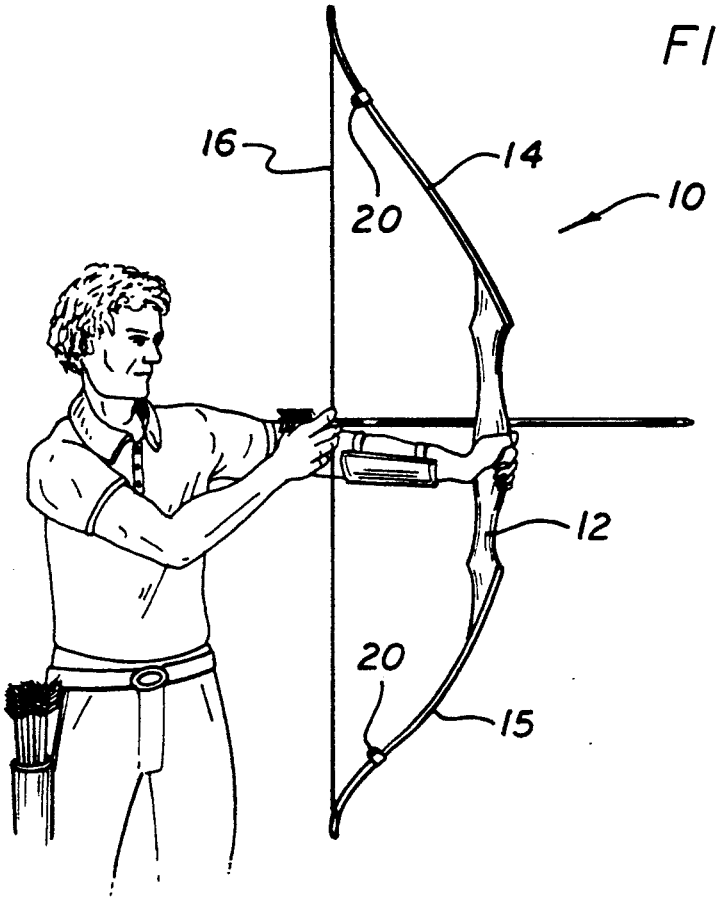
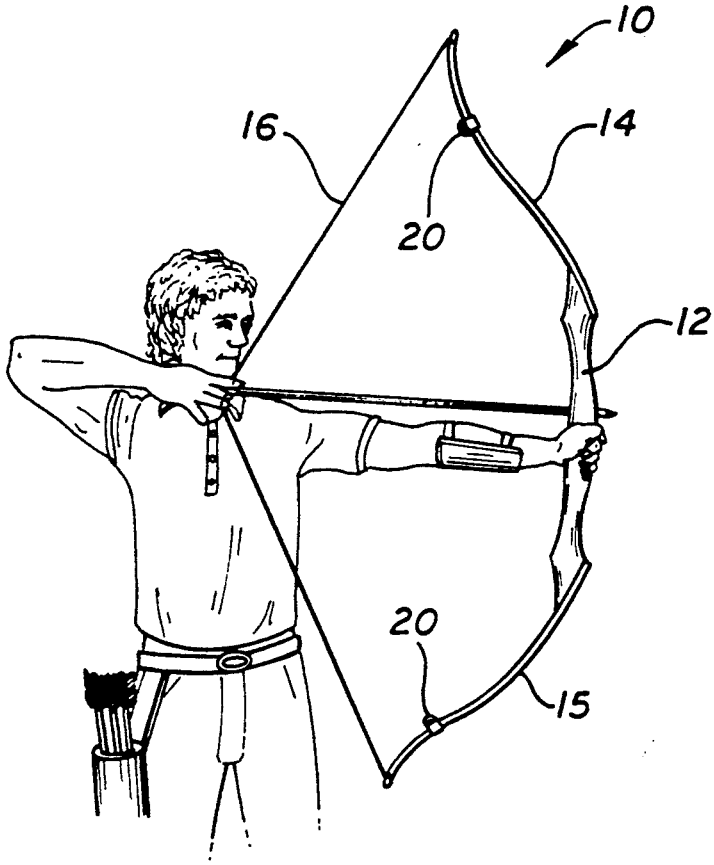
FIG. 1B

ADJUSTABLE LIMB STABILIZER AND BOWSTRING ACCELERATOR BLOCK

BACKGROUND OF THE INVENTION AND PRIOR ART

1. Field of the Invention

This invention relates in general to archery and, more particularly, to recurve bow archery.

2. Prior Art

Conventional recurve bows have a handle and a pair of limbs which may be constructed either integrally with the bow handle or as separate parts attachable to the handle. The term "recurve bow" refers to bows which have a main curvature which is convex away from the archer and a pair of end curves which are convex toward the archer until the bow is drawn at which time the end curves change their configuration, i.e. "recurve" to follow the curvature of the main bow curvature. As the bowstring is released, the bowstring propels the arrow forwardly at a first rate of acceleration until the bowstring contacts the bow limbs after the end curves have returned to their original shape at which time the arrow is propelled at a second higher rate of acceleration due to the shortened free length of bowstring. In high level world class target recurve bow archery events, arrows leave the bow at speeds in excess of 200 feet per second. The speed is a direct function of the free bow and bowstring length, i.e., the distance between points of contact of the string with the bow. Even slight increases in arrow speed translate to improved accuracy in target shooting.

It is therefore an object of the present invention to increase the speed at which arrows are propelled by a recurve bow without materially altering the bow dimensions or draw weight.

SUMMARY OF THE INVENTION

The present invention accordingly provides a limb stabilizer and bowstring accelerator block for attachment to the limb of a recurve bow, said block comprising an elongated body having a limb contact surface and a bowstring contact surface on the side of said body opposite said limb contact surface and means for affixing said block to a limb of a recurve bow.

The present invention further provides a recurve archery bow having a handle and a pair of recurve bow limbs, each limb having a limb stabilizer and bowstring accelerator block mounted thereon, each block comprising an elongated body having a bowstring contacting surface on the side on said body opposite said limb and means affixing said blocks to said limbs.

BRIEF DESCRIPTION OF THE DRAWINGS

FIGS. 1A–1C respectively show side views of a recurve bow in a strung but undrawn configuration; in a configuration when drawn to its full draw length in preparation for shooting; an in a released configuration during shooting after release of the bowstring where the bowstring has contacted the accelerator blocks on the recurve limbs.

DESCRIPTION OF THE PREFERRED EMBODIMENTS

Figure 1C:
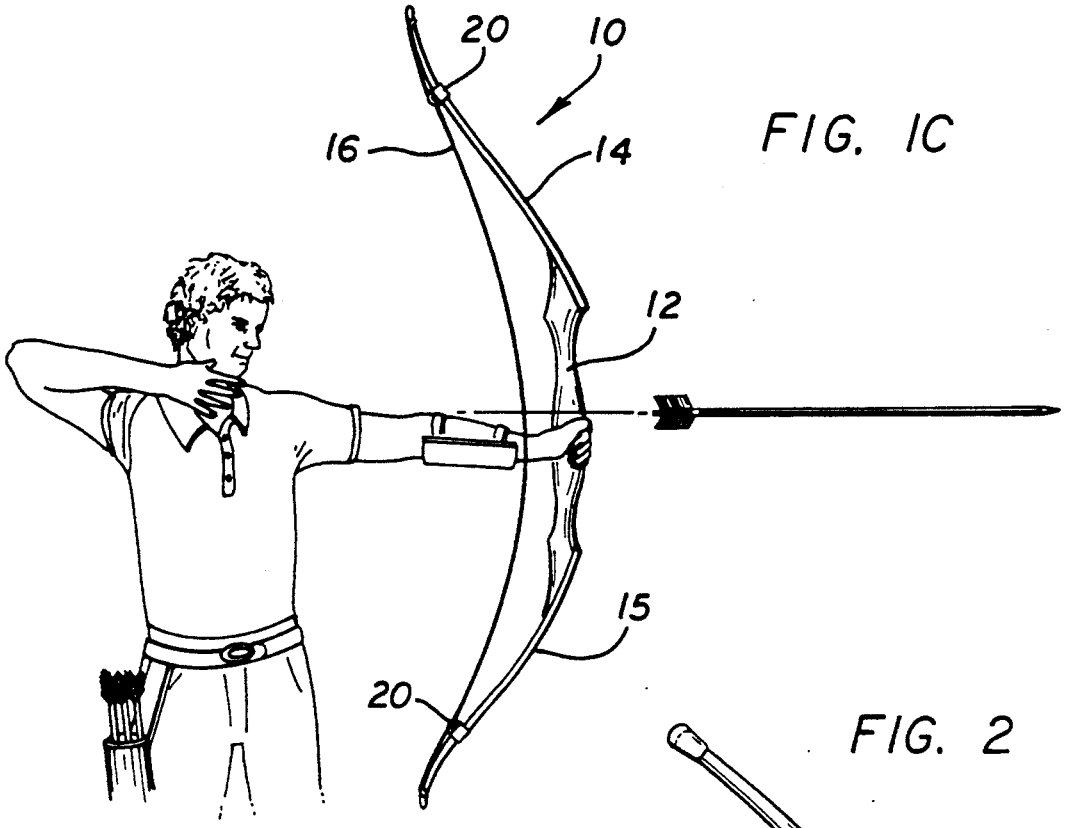

As seen in FIG. 1A, a recurve bow 10 has a handle section or riser 12 and a pair of either integrally formed or separately removable limbs 14, 15 which each have a slight "S" configuration when the limbs are attached to the handle 12 and the bowstring 16 is strung from limb tip to limb tip. The limbs 14, 15 are ordinarily removable and are mounted on the riser 12 in limb pockets as is conventional. Note particularly that the bowstring 16 contacts the forward side (archer's side) of the end recurves of the bow limbs. A centered groove 18 (FIG. 3) may be provided on the archer's side of the limb tips in the area where the string 16 contacts the ends of the recurve portions of the limbs 14, 15. As the bow is drawn to its full draw length as seen in FIG. 1B, the limb end curves substantially straighten and are no longer in contact with the bowstring 16. During shooting when the arrow is propelled by the bowstring as seen in FIG. 1C, the bowstring 16 during its forward motion contacts adjustable accelerator blocks 20 on the archer's side of the recurve limbs 14, 15 thus shortening its free or effective length and propelling the arrow forward with increased velocity.

Figure 2:
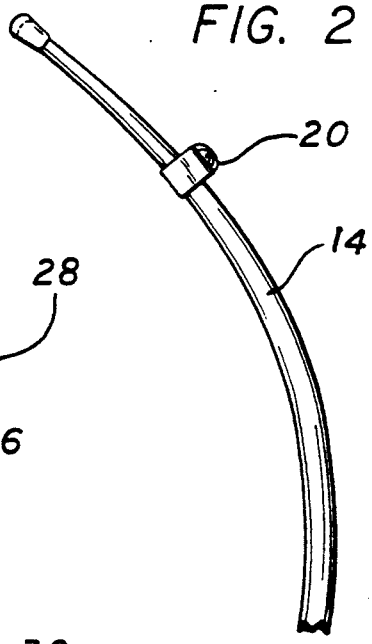
FIG. 2 is a side View to an enlarged scale of an adjustable accelerator block attached to a limb of an unstrung recurve bow.
Figure 3:
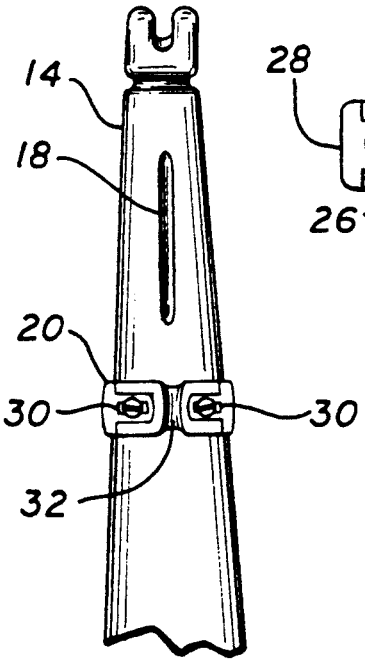
FIG. 3 is a front view (from the archer's side) to the same scale as FIG. 2 of the bow limb and accelerator block of the present invention.
Figure 4:
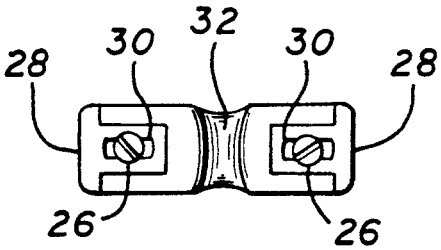
FIG. 4 is a plan view to an slightly enlarged scale of the adjustable accelerator block.
Figure 5:
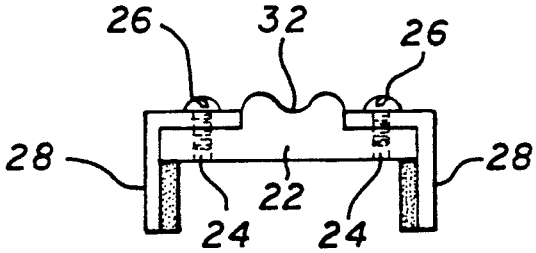
FIG. 5 is an elevation view of the accelerator block of FIG. 4.

FIGS. 2 and 3 respectively show side and front views of adjustably mounted accelerator blocks 20 which can easily be positioned at selected distances from the limb tips to allow for dynamic adjustment and balance of the limbs and/or the blocks can be adjusted laterally to compensate for misalignment of the limb caused by one or more of a crooked limb, misalignment in the riser 12, limb pocket or other section of the bow. Alternatively, the blocks can simply be cemented in a permanent location on the limbs. In the preferred from, the blocks 20 are adjustable and comprise a main block body 22 having a pair of laterally extending wings 24 which each receive a threaded fastener 26 which clamps an adjustable L-shaped side plate 28 thereto. The side plates 28 each are provided with a rubber cushion 29 on the inside bow limb contacting surface to cushion and grip the bow limb to prevent slippage. Fasteners 26 extend through elongated slots 30 in the side plates 28 to permit lateral adjustment of the side plates 28 relative to the main block body 22 so that the blocks 20 can be positioned where desired on the limbs 14, 15. The main block body essentially comprises an elongate bar which is mounted transversely on the limb, the bar having a centrally positioned string receiving groove 32 as shown.

Tests have been made which have surprisingly revealed that properly positioned accelerator blocks result in an increase of the order of about 2 percent in the arrow speed—i.e., from about 205 feet per second to 208–209 feet per second. The increased arrow velocity is attributable to the fact that the bowstring is effectively shortened when the string comes into contact with the blocks 20. After a shot, the blocks also quickly stabilize the limbs and reduce residual oscillation of the bow.

Persons skilled in the art will readily appreciate that various modifications can be made from the preferred embodiment thus the scope of protection is intended to be defined only by the limitations of the appended claims in which reference numerals have been included merely for explanation rather than limitation.

I claim:

1. A limb stablizer and bowstring accelerator block for attachment to the limb of a recurve bow, said block comprising an elongated body having a limb contact surface and a bowstring contact surface on the side of said body opposite said limb contact surface, said bowstring contact surface contacint said bowstring to shorten the effective length of the bowstring during shooting to accelerate the speed of said bowstring and reduce residual oscillation of the bow limbs after a shot, and means for affixing said block to a limb of a recurve bow at a selected position therealong, wherein said block includes a pair of side plates adjustably fastened to said elongated body.

2. A limb stablizer and bowstring accelerator block according to claim 1, wherein each of said side plates has a cushioned bow limb gripping surface thereon.

3. A limb stablizer and bow string accelerator block according to claim 2, wherein each of said side plates is of generally L-shaped configuration.

4. A recurve archery bow having a handle and a pair of recurve bow limbs, each limb having a limb stablizer and bowstring accelerator block mounted thereon, each block comprising an elongated body having a bowstring contacting surface comprising a longitudinally centered string contact groove on the side of said body opposite said limb, said bowstring contacting surfaces contacting said bowstring to shorten the effective length of the bowstring during shooting to accelerate the speed of said bowstring and reduce residual oscillation of the bow limbs after a shot, and means affixing said blocks to said limbs, wherein each of said blocks includes a pair of side plates adjustably fastened to said elongated body.

5. A bow according to claim 4, wherein each of said side plates has a cushioned bow limb gripping surface thereon.

6. A bow according to claim 5, wherein each of said side plates is of generally L-shaped configuration.

7. A bow according to claim 4, wherein said limbs and handle are integral.

* * * * *